United States Patent [19]

Sietmann et al.

[11] 3,943,636

[45]*Mar. 16, 1976

[54] APPARATUS FOR DRYING GRAIN

[76] Inventors: Vernon H. Sietmann; Larry S. Keese; Raymond L. Smith, all of Laurel, Iowa 51041

[ * ] Notice: The portion of the term of this patent subsequent to Nov. 26, 1991, has been disclaimed.

[22] Filed: Mar. 8, 1974

[21] Appl. No.: 449,379

Related U.S. Application Data

[63] Continuation-in-part of Ser. No. 364,955, May 29, 1973, Pat. No. 3,849,901.

[52] U.S. Cl. ..... 34/44; 34/52; 34/56; 34/167

[51] Int. Cl.[2] ..... F26B 19/00

[58] Field of Search ..... 34/44, 52, 56, 167, 174; 60/325, 330

[56] References Cited

UNITED STATES PATENTS

| | | | |
|---|---|---|---|
| 3,023,568 | 3/1962 | Gilliland | 60/325 |
| 3,479,748 | 11/1969 | Sietmann | 34/33 |
| 3,501,845 | 3/1970 | Sietmann | 34/33 |
| 3,634,949 | 1/1972 | Louks | 34/174 |
| 3,849,901 | 11/1974 | Sietmann et al. | 34/44 |

*Primary Examiner*—Kenneth W. Sprague
*Assistant Examiner*—Larry I. Schwartz
*Attorney, Agent, or Firm*—Zarley, McKee, Thomte & Voorhees

[57] ABSTRACT

A hydraulic torque convertor is disclosed which is particularly well-adapted for use with an apparatus for drying grain. The apparatus for drying grain comprises a conical shaped perforated floor which is mounted in a conventional grain drying bin in a raised position relative to the base floor thereof. The perforated floor has a plurality of grain discharge openings formed adjacent the outer ends thereof, each of which are selectively closed by a trap door valve means. An electric motor is operatively connected to the hydraulic torque convertor which is operatively connected to the valve means for moving the valve means between open and closed positions responsive to the temperature of the grain positioned on the floor. The hydraulic torque convertor comprises a disc shaped rotor which is connected to the output shaft of the electric motor. A housing rotatably embraces the end of the output shaft and the rotor and is operatively connected to a horizontally disposed shaft extending therefrom. The rotor has a plurality of spaced apart fins on the periphery thereof. The housing has a plurality of spaced apart fins provided on the interior peripheral surface thereof which are positioned outwardly of the rotor fins. The rotor has less fins than does the housing which serves as a gear reduction. The housing is partially filled with hydraulic fluid. Rotation of the rotor by the electric motor causes the fluid to be moved towards the periphery of the rotor by centrifugal force which causes the housing to be rotated which in turn causes the shaft connected thereto to also be rotated. The horizontally extending shaft is connected, by a chain, to a rotatable drum having an elongated flexible cable wound thereon and extending therefrom to the valve means to cause the operation of the same. A pair of stop elements are provided on the cable for limiting the movement of the cable.

4 Claims, 6 Drawing Figures

APPARATUS FOR DRYING GRAIN

BACKGROUND OF THE INVENTION

This application is a continuation-in-part application of application Ser. No. 364,955 filed May 29, 1973 now U.S. Pat. No. 3,849,901.

This invention pertains to a hydraulic torque convertor and more particularly to a hydraulic torque convertor which may be used in the drying of granular materials such as grain. Many attempts have been made to provide a means for satisfactorily drying grain. One method utilizes a grain drying bin while another method utilizes a portable batch dryer. A still further method utilizes a grain drying bin which dries one batch at a time but which then requires that the batch be transferred to another bin for storage purposes. A disadvantage of the first method referred to above is primarily in subjecting several lower levels of the grain in the bin to the drying process several times. Also, in introducing the grain to be dried into this type of bin, it must be leveled by mechanical means, and in some instances stirring auger type devices are used to aid aeration of the grain. The second and third methods require additional equipment to the storage equipment, all of which increase the drying costs and the possible damage to the grain by over-handling.

Another method of grain drying, not as well known as the former methods, is that of batch drying grain within the upper portion of a conventional grain drying bin. This latter method uses a substantially horizontal floor with trap doors or gate means formed therein, and with drying air being forced beneath the upper floor, passing therethrough to dry the grain thereabove. After drying, the grain is dumped onto the base floor of the bin for storage purposes. Disadvantages of this method are believed to include an excess of equipment such as a grain leveler mounted above the upper floor for distributing grain in a level manner thereon, and the provision of a sweep auger also directly above the upper floor for aiding in the dumping of the grain after drying through the doors or gate.

The air torque convertor illustrated and disclosed in applicant's co-pending application represented a significant advance in the art. The hydraulic torque convertor disclosed herein which replaces the air torque convertor of the said co-pending application represents a significant advance in the art.

Therefore, it is a principal object of this invention to provide an improved hydraulic torque convertor.

A further object of the invention is to provide a hydraulic torque convertor which may be used in combination with an apparatus for drying grain.

A further object of the invention is to provide a hydraulic torque convertor which does not require that the housing be completely filled with hydraulic fluid.

A further object of the invention is to provide a hydraulic torque convertor which serves as a gear reducer.

A further object of the invention is to provide a hydraulic torque convertor having improved efficiency.

A further object of this invention is to provide an apparatus for drying drain which can be added to conventional grain bins in an economical manner.

A still further object of the invention is to provide a grain drying apparatus for use in conventional grain bins wherein storage space therein is used to the utmost.

A still further object of this invention is to provide a grain drying apparatus including means for precisely controlling the operation of the supply auger and the gas dryer.

A still further object of the invention is to provide an apparatus for drying grain including means for controlling the flow of the dried grain from a perforated drying floor.

A still further object of the invention is to provide a grain drying apparatus including means for more evenly drying the grain.

A still further object of the invention is to provide a grain drying apparatus which conserves energy by using the cooling air to help dry the grain.

A last objective is to provide a torque convertor which can provide the work intended but also to waste away the marginal energy without overloading the motor.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
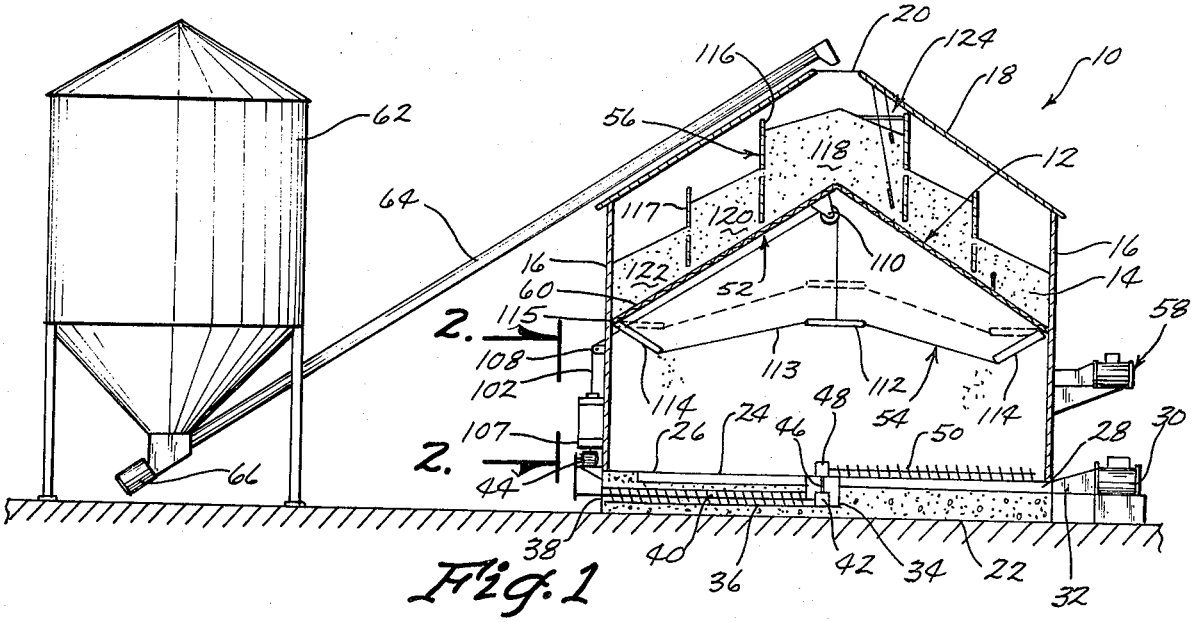
FIG. 1 is a partial vertical cross-sectional view of the grain drying apparatus of this invention shown and installed in an assembled relationship within a grain bin and having the hydraulic torque convertor of this invention mounted exteriorly of the grain bin.

The numeral 10 generally designates a conventional grain bin which houses the grain drying apparatus indicated generally at 12 which is capable of drying material 14 for subsequent storage in the lower part of the bin 10. The grain drying apparatus disclosed herein is identical to that described in applicant's co-pending application with the exception of the power means for operating the valve means which will be described in more detail hereinafter.

The grain bin 10 comprises a side wall 16 and a conical shaped roof 18 mounted thereon. An opening 20 is formed in the apex of the roof 18, and therebelow is found a foundation or base floor 22. The base floor 22 has an X-shaped trough 24 formed therein, and spaced above the surface of the base floor 22 is a perforated plate 26 capable of holding granular material while enabling air from therebelow to pass upwardly therethrough.

One leg of the trough 26 communicates to the exterior of the bin 10 through a passageway 28 formed in the side wall 16. A blower system 30 is fluidly connected with the trough 24 through a duct 32, and upon energizing the blower 30, air is forced into the trough 24 whereupon it circulates upwardly through the perforated floor plate 26 and through granular materials stored thereon for aeration purposes.

At the center of the lower floor 22, a sump opening 34 is formed therein which fluidly communicates with a tunnel 36 formed in the lower floor 22. The tunnel 36 leads from the sump opening 34 to an area 38 immediately outside the bin. An auger 40 is axially mounted in the tunnel 36, with one end thereof secured to a gear housing 42 mounted in the base of the sump opening 34, with the other end extending to the area 38. A motor 44 is mounted on the outside of the bin 10 and is belt connected to the auger 40 for rotating the same.

The gear housing 42 has a vertically disposed shaft 46 rotatably mounted therein which extends upwardly therefrom. Secured to the upper part of the shaft 46 is a second gear housing 48. A sweep auger 50 is rotatably attached to the gear housing 48 and is operated thereby. The motor 44 is operable to rotate the auger 36 which in turn causes the sweep auger 50 to rotate about its horizontal axis and to rotate about the shaft 46. The purpose of the auger 36 and the sweep auger 50 will be described in more detail hereinafter.

The drying apparatus 12 of this invention comprises generally an overhead floor structure indicated generally at 52, a grain discharge apparatus indicated generally at 54 and a grain leveling control apparatus indicated generally at 56 in FIG. 1. A drying apparatus indicated generally at 58 is also utilized with the invention and of course is necessary for the entire drying process to occur.

The overhead floor structure 52 comprises specifically a conical shaped perforated floor 60 with the slope of the floor 60 being generally parallel to the slope of the roof 18, although this is not critical.

The numeral 62 generally comprises a storage bin having a conveyor auger 64 extending from the lower end thereof which is in communication with the opening 20. Conveyor auger 64 is driven by the electric motor 66.

Figure 2:
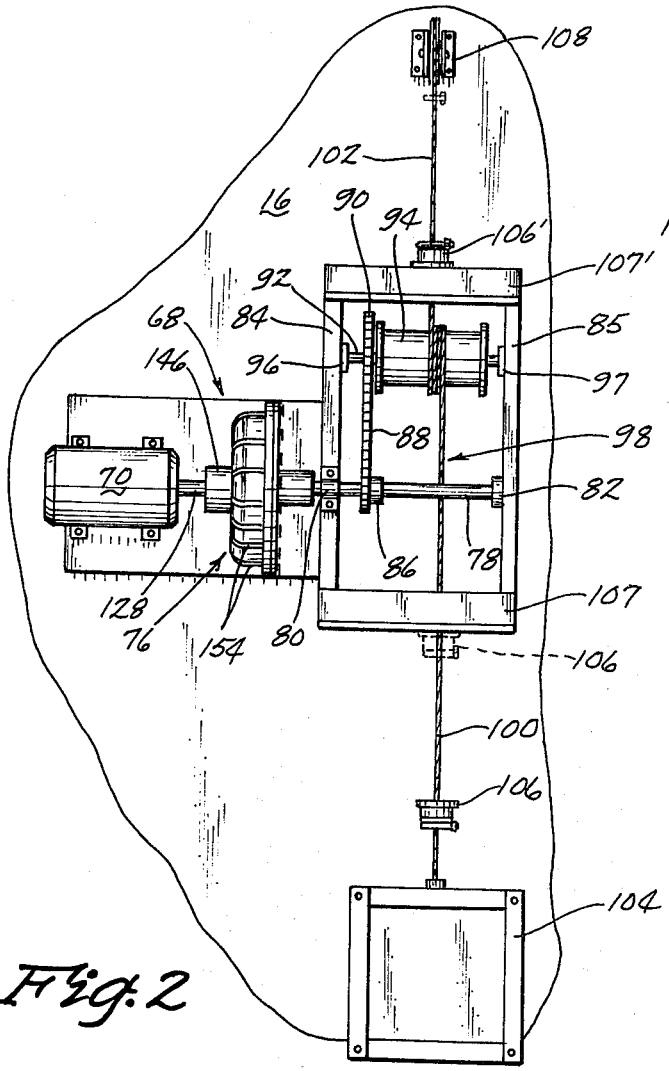
FIG. 2 is an enlarged sectional view seen on lines 2 — 2 of FIG. 1.
Figure 3:
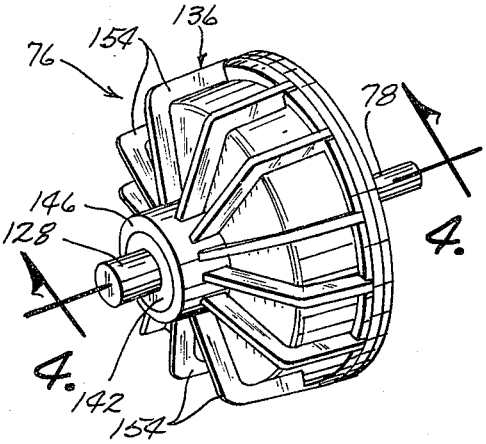
FIG. 3 is a partial perspective view of the hydraulic torque convertor.

Grain discharge apparatus 54 generally comprises a support means 68 which is secured to the outside surface of wall 16 as seen in FIGS. 1 and 2. Electric motor 70 is secured to the support means 58 as seen in FIG. 2 and drives the hydraulic torque convertor 72 which will be described in more detail hereinafter. Shaft 78 is rotatably mounted in bearings 80 and 82 which are mounted on the vertically disposed support members 84 and 85 of support means 68. Sprocket 86 is mounted on shaft 78 and drives a chain 88 extending therearound. Chain 88 extends around a sprocket 90 mounted on the rotatable shaft 92 which is operatively secured to the drum 94. Shaft 92 is supported by bearings 96 and 97 mounted on support members 84 and 85.

The numeral 98 refers to a flexible cable or the like which is wound upon the drum 94 so that rotation of the drum 94 in one direction will cause the cable lengths 100 and 102 to move upwardly. Rotation of the drum 94 in an opposite direction will cause the cable lengths 100 and 102 to move downwardly. A counter weight 104 is secured to the lower end of cable length 100. Stops 106 and 106' are adjustably secured to cable lengths 100 and 102 respectively for engaging the angle members 107 and 107' respectively to limit the travel of the cable 98. Cable length 102 extends over pulley 108 secured to wall 16 and thence inwardly into the bin 10 as seen in FIG. 1. Cable length 102 extends over pulley 110 secured to floor 60 and thence downwardly where it is secured to a support 112.

A plurality of cables 113 are secured to the support 112 and extend radially therefrom in the same manner as in the co-pending application. Each of the cables 113 are secured to one end of a trap door generally referred to by the reference numeral 114. Each of the trap doors 114 are pivotally connected at 115 to the overhead floor structure 52 as illustrated in FIG. 1. The perforated floor 60 is provided with an opening formed therein which is positioned above the outer end of each of the trap doors 114. Each of the trap doors 114 are channel or U-shaped comprising generally a bottom and upstanding sides. The configuration of the trap doors 114 are identical to that described in the co-pending application.

Grain leveling apparatus 56 generally comprises a first circular wall means 116 extending between the roof 18 and the overhead floor structure 52 and positioned centrally with respect thereto as seen in FIG. 1. As seen in FIG. 1, the lower end of the wall means 116 terminates above the perforated floor 60. An outer wall means 117 is positioned above the overhead floor structure 52 as illustrated in FIG. 1 and extends around the wall means 116. FIG. 1 illustrates the fact that the upper end of the wall means 117 is spaced below the roof 18 to permit the passage of air therebetween. The lower end of the wall means 117 is also spaced above the perforated floor 60. For purposes of description, the wall means 116 and 117 define grain cells 118, 120 and 122.

The grain flows through openings formed in wall means 117 so as to achieve a predetermined level in the grain cell 122. Likewise, the grain will flow through the openings formed in the wall means 116 so as to achieve a predetermined grain level in cell 120. The level of the grain in grain cell 118 is controlled by a sensing apparatus referred to generally by the reference numeral 124 which is identical to the sensing apparatus disclosed in the copending application. All of the structure previously described is identical to the structure described in the co-pending application with the exception of the hydraulic torque convertor 76 which is employed to control the operation of the trap doors 114 rather than the air torque convertor of the co-pending application.

Figure 4:
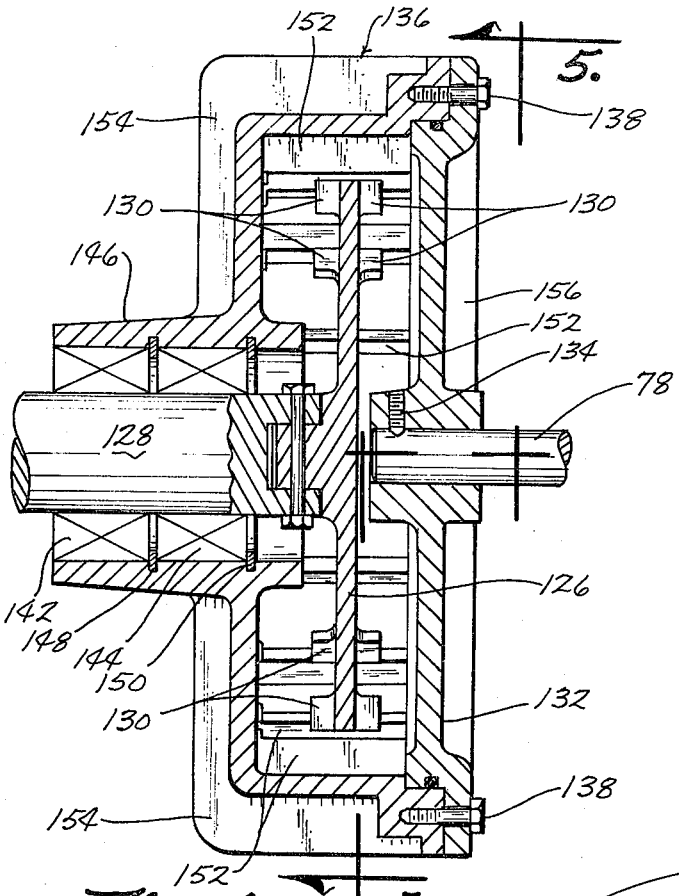
FIG. 4 is an enlarged sectional view seen on lines 4 — 4 of FIG. 3.
Figure 6:
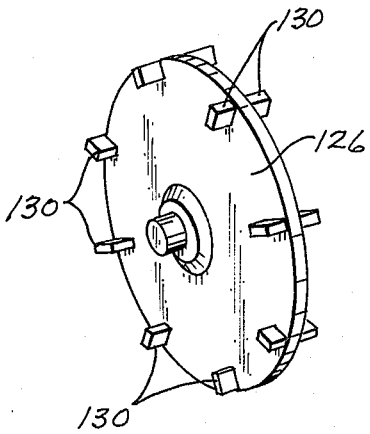
FIG. 6 is a partial perspective view of the rotor of the hydraulic torque convertor.
Figure 5:
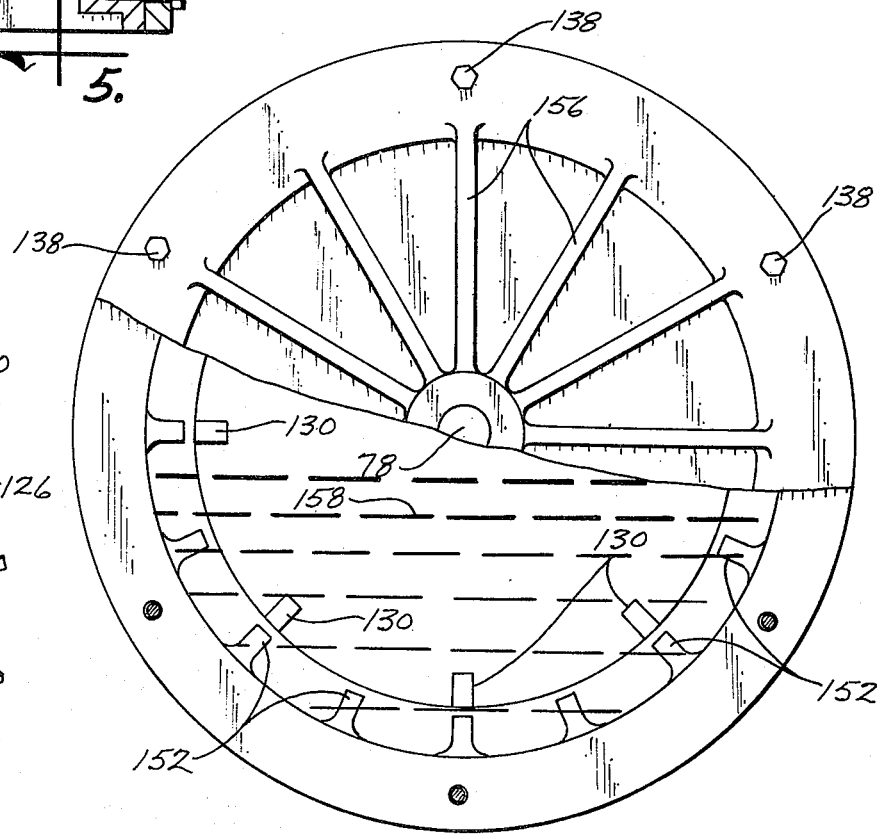
FIG. 5 is a sectional view seen on lines 5 — 5 of FIG. 4.

Torque convertor 76 comprises generally a rotor 126 which is secured to the outer end of the shaft 128 extending from the electric motor 70. Rotor 126 is provided with a plurality of spaced apart fins 130 provided at the periphery thereof as best seen in FIG. 6. As seen in FIG. 6, the fins 130 are positioned on both sides of the rotor 126. The numeral 132 refers to an end plate which is secured to the shaft 78 by set screw 134 as illustrated in FIG. 4. End plate 132 is secured to a housing 136 by a plurality of screws 138. As seen in FIG. 4, an O-ring 140 is provided between the end plate 132 and the housing 136 for sealing purposes.

Bearings 142 and 144 embrace shaft 128 and are positioned between the shaft 128 and the hub 146 of housing 136. Snap rings 148 and 150 maintain the bearings in position. As seen in FIG. 4, housing 136 is provided with a plurality of radially extending spaced apart fins 152. Housing 136 is also provided with a plurality of strengthening ribs 154 while the end plate 132 is provided with a plurality of strengthening ribs 156. Preferably, the number of fins 152 is greater than the number of the fins 130 to provide a gear reduction effect. The hydraulic torque convertor operates with the housing approximately half full of fluid generally indicated by the reference numeral 158. Thus, rotation of the shaft 128 by the electric motor causes rotor 126 to be rotated. Rotation of the rotor 126 causes the fluid in the housing to be moved outwardly due to centrifugal force. The fluid being forced outwardly by the rotating rotor 126 causes the housing 136 to be rotated since the hydraulic fluid is impinged upon the fins 152 thereby causing the rotation of the end plate 132 and the shaft 78. The torque convertor exhibits high efficiency since the fluid is moved to the periphery of the housing by the rotor and it is at the periphery where the torque converting action occurs. While the torque convertor disclosed herein works especially well with the grain drying apparatus previously described, it should be noted that the hydraulic torque convertor may also be used in any environment requiring a hydraulic coupling or torque convertor action.

Assuming that the grain cells 118, 120 and 122 are initially empty, the normal method of operation is as follows. Initially, the trap doors 114 will be in their horizontal or closed position such as illustrated by broken lines in FIG. 1. The sensing mechanism 124 will also be in a position so as to indicate that grain cell 118 is empty. A master switch is initially closed when it is desired to begin the drying operation. The closing of the master switch causes auger motor 66 to be energized so that grain will be conveyed from the storage bin 62 to the upper open end of the bin. The grain will be deposited in the grain cell 118 and the grain will flow downwardly and outwardly into the grain cells 120 and 122 to achieve the levels illustrated in FIG. 1. The construction of the wall means 116 and 117 and the perforations formed therein is such that the desired level of grain is maintained without avalanching the same. Since the trap doors 114 are closed, the grain will dam up on the outer ends of the trap doors to prevent the grain from flowing through the openings formed at the lower end of the perforated floor 60.

Auger motor 66 continues to operate to supply grain to the grain cell 118 and the grain in the grain cell 118 will actuate the sensing mechanism 124 at the proper time to indicate that the grain cells are at the desired level. When the sensing mechanism 124 has been removed to the position illustrated in FIG. 1, the auger motor 66 is deactivated. Thus, heated air is passed upwardly through the perforated floor 60 by the dryer apparatus 58 and the blower apparatus 30. Blower apparatus 30 cools the heated dry grain. The heated air will be passed through the grain in the grains cells until the thermostat senses a grain temperature of approximately 120° F. When the thermostat senses 120° F., the motor 70 is actuated to cause the rotation of the rotor 126 which in turn causes the rotation of the housing 136 and the shaft 78 as previously described. Rotation of the shaft 78 causes the drum 94 to be rotated. Rotation of the shaft 94 causes cable lengths 100 and 102 to move upwardly. The cable lengths 100 and 102 move upwardly until stop 106 engages angle member 107. Thus, counterweight 104 is moved to is uppermost position. The motor 70 operates longer than necessary to lift the counterweight to its maximum upper position, but the torque convertor means 76 prevents any damage from occurring to the components as motor 70 and rotor 126 continue to operate while the housing 136 stops.

As the grain flows from grain cell 122 outwardly through the openings onto the trap doors 114, the grain in grain cell 120 will tend to flow into the grain cell 122. The grain in grain cell 118 will also flow into the grain cell 120 as the grain is discharged onto the trap doors. The sensing mechanism 124 senses when the grain level in grain cell 118 reaches a predetermined level to again activate the auger motor 66 to supply additional grain to grain cell 118.

As the cool wet grain is introduced into the bin 10, the thermostat again opens which causes the motor 70 to be deactivated. When motor 70 is deactivated, the counterweight 104 causes the drum 94 to be rotated which causes the cable length 102 to pull the support 112 upwardly so that the cables 113 move the trap doors from their open position (solid lines, FIG. 1) to the closed position (dotted lines, FIG. 1) so that the grain will be maintained on the perforated floor until the predetermined drying temperature is achieved. Drum 94 is free to rotate since there is no direct connection but a fluid connection between the drum 94 and the motor 70. Furthermore, the clearance (usually 3/32 inch) between the impeller fins 130 and the fins 152 permits and allows the marginal energy to be wasted away without damage to the motor. The motor is not run backwards by the counterweight. There is no torque loss except in the bearings. In case of an electrical failure, the counterweight will automatically drop and the system will shut down.

It should be understood that the apparatus for drying grain disclosed herein is identical to the apparatus of the co-pending application and reliance on that disclosure is made herein.

Thus it can be seen that the apparatus accomplishes at least all of its stated objectives.

I claim:

1. An apparatus for drying granular material in a grain bin having an enclosure forming wall, a roof mounted over the wall, and a base floor for the wall, the apparatus comprising:

a floor mounted in the upper part of the bin, said floor being inclined and sloping downwardly from the center of the bin toward and in contacting relation with the wall whereby granular material disposed on said floor is normally prevented from falling onto said base floor, said floor having a plurality of spaced apart openings formed therein adjacent said wall through which the granular material can fall, a valve means positioned below each of said openings and being movable between open and closed positions to permit granular material to fall through said openings and to prevent granular material from falling through said openings respectively, means for opening and closing said valve means including a motor having an output shaft, a counterweight operatively connected to said valve means, and a hydraulic torque convertor means operatively connecting said output shaft and said counterweight, means for supplying drying air within the bin and below said floor, a thermostat means on said floor for sensing the temperature of the granular material thereon, said thermostat means being operatively connected to said means for opening and closing said valve means so that said valve means will be opened when said thermostat means senses a first predetermined temperature and so that said valve means will be closed when said thermostat means senses a second predetermined temperature.

2. The apparatus of claim 1 wherein said means for opening and closing said valve means comprises an electric motor having an output shaft, a second shaft disposed in a parallel, and spaced apart end-to-end relationship with respect to said output shaft, a hydraulic torque convertor means operatively connecting said output shaft and said second shaft so that rotation of said output shaft will cause the rotation of said second shaft, a third shaft disposed in a parallel relationship to said second shaft, means connecting said second and third shafts so that rotation of said second shaft will cause the rotation of said third shaft, a drum means mounted on said third shaft for rotation therewith, a flexible cable means wound upon said drum means and having first and second cable lengths extending therefrom, a support means secured to said first cable length, a plurality of flexible members connected to said support and said valve means so that rotation of said drum means in one direction will cause said valve means to open and so that rotation of said drum means in an opposite direction will cause said valve means to close, and a counterweight means secured to said second cable length which is moved upwardly when said drum means is rotated in said one direction.

3. The apparatus of claim 2 wherein each of said valve means comprises a valve member having inner and outer ends and being pivotally secured at its outer end to said bin and extending radially inwardly therefrom, the outer end of said valve member being disposed below one of said openings, the inner end of said valve member being connected to said means for opening and closing said valve means.

4. The apparatus of claim 1 wherein said means for opening and closing said valve means comprises a hydraulic torque convertor, said convertor comprising a power means having a drive shaft extending therefrom, a substantially flat rotor operatively secured to said drive shaft for rotation therewith, said rotor having a plurality of spaced apart fins secured thereto at the periphery thereof, a housing rotatably mounted on said drive shaft and enclosing said rotor, said housing having a plurality of spaced apart fins provided therein which are spaced radially outwardly of the fins on said rotor, an output shaft secured to said housing for rotation therewith, and fluid in said housing to provide a fluid coupling between said rotor and housing so that rotation of said rotor by said drive shaft will cause the rotation of said housing.

* * * * *